United States Patent [19]

Ide

[11] 4,008,916

[45] Feb. 22, 1977

[54] LOAD UNITIZER

[76] Inventor: Allan R. Ide, 10066 Bloomfield, Cypress, Calif. 90630

[22] Filed: Nov. 6, 1975

[21] Appl. No.: 629,328

[52] U.S. Cl. ..... 294/67 R; 214/10.5 R; 220/1.5

[51] Int. Cl.[2] ..... B66C 1/16

[58] Field of Search ..... 294/67 R, 67 B, 67 C, 294/67 D, 67 DA, 67 DB, 67 DC; 214/10.5 R, 10.5 S, 147 AS, 147 T; 211/189, 194, 85; 108/55, 53, 57; 220/115, 84, 4 F

[56] References Cited

UNITED STATES PATENTS

| | | | |
|---|---|---|---|
| 2,071,334 | 2/1937 | Fitch | 220/1.5 |
| 2,099,116 | 11/1937 | Kalmbach | 294/67 |
| 3,386,600 | 6/1968 | Betjemann | 294/67 R |
| 3,543,951 | 12/1970 | Marvin | 214/10.5 R |
| 3,797,691 | 3/1974 | Williams, Jr. | 220/1.5 |

*Primary Examiner*—James B. Marbert
*Attorney, Agent, or Firm*—Fulwider, Patton, Rieber, Lee & Utecht

[57] ABSTRACT

There is disclosed a load unitizer including upper and lower frames formed with spaced apart co-extensive corner retainers for engaging the diagonally opposed corners of polygonal-shaped cargo articles collected together in a row and coupling means is provided for coupling the opposite sides of the upper and lower frames together. Such coupling means includes a pair of connecting arms pivotally connected on their upper extremities in spaced apart relationship to one side of the upper frame and formed on their lower extremities with respective first hooks. Second hooks are mounted from one side of the lower frame in spaced apart relationship and holding means is provided for holding the first and second hooks connected together while the unitizer is transported about to transfer such cargo.

9 Claims, 7 Drawing Figures

FIG. 4
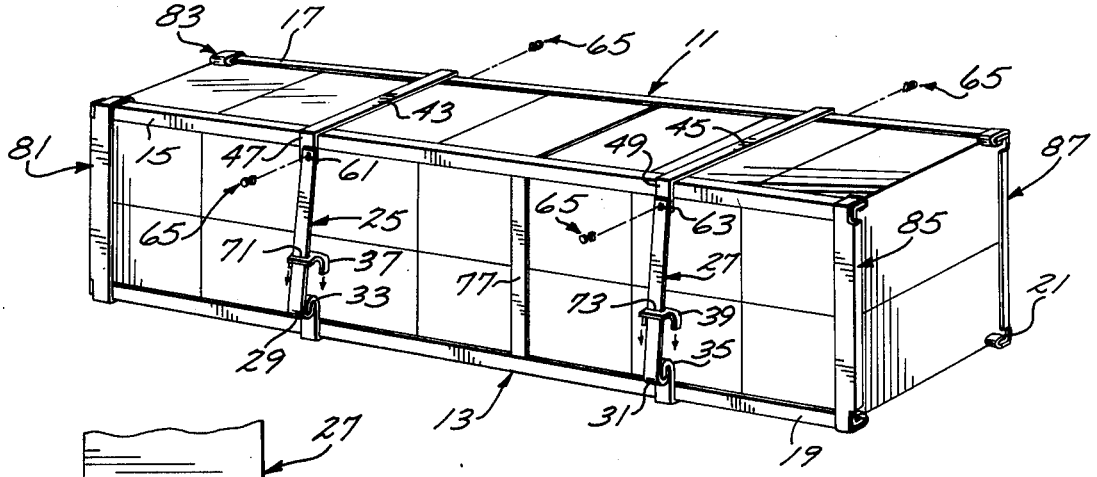
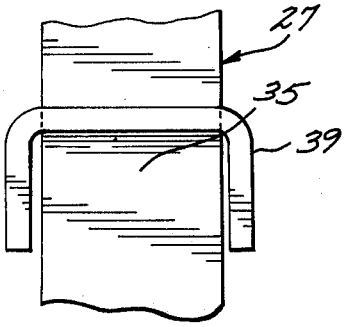
FIG. 6
FIG. 7
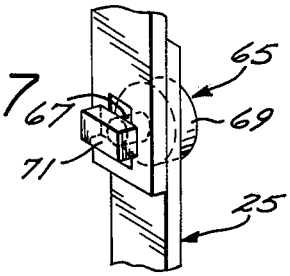
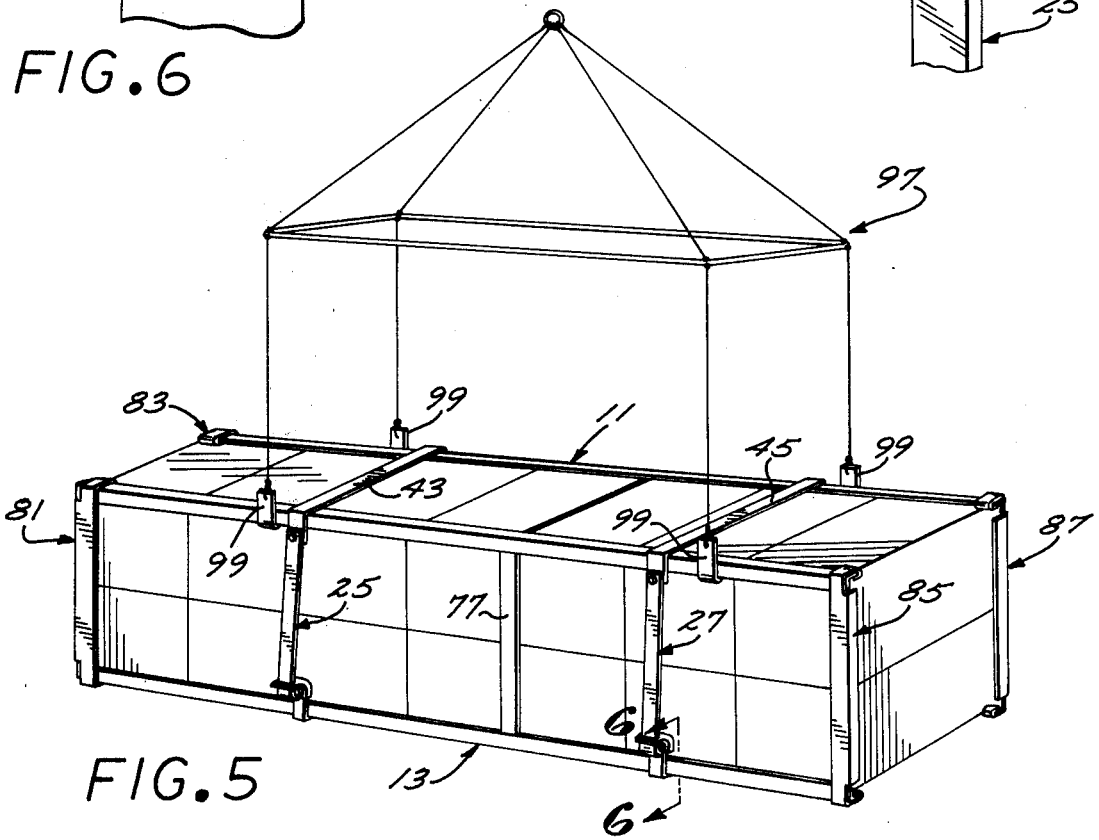
FIG. 5

LOAD UNITIZER

BACKGROUND OF THE INVENTION

1. Field of the Invention

The present invention relates to cargo handling devices and more particularly to devices for collecting a plurality of pieces of cargo together in unit form for transportation as a unit from one point to another.

2. Description of the Prior Art

With the increased cost of labor and increasing volume of import and export, many efforts have been made to minimize the labor required for loading and unloading cargo from ships and for minimizing the lay time for a cargo ship at dock. Such efforts have led to the containerization of cargo wherein rigid or even collapsible containers are provided at the plant of production and into which numerous different pieces of cargo are unloaded for transportation to the dock to await loading on board ship. When the cargo ship is ready to be loaded, the containers are moved into position and loaded on board the ship and such containers, together with the cargo contained therein, transported by ship to the new destination. There the containers are unloaded from the ship and the cargo may then be unloaded from the containers themselves and, if return cargo is not available, the containers themselves may be shipped back to their port of origin for subsequent use. The cost of conventional containers of this type has become prohibitive for shipping certain cargo articles and the space occupied thereby during shipment in their empty condition significantly detracts from the economic feasibility of use.

SUMMARY OF THE INVENTION

The load unitizer of the present invention is characterized by a pair of upper and lower frames incorporating parallelly spaced apart corner retainers which engage diagonally disposed corners of polygonal cargo articles with such frames being connected together by coupling means. The coupling means includes a pair of coupling arms pivotally connected on their upper extremities to one side of the upper frame and formed on their lower extremities with first hooks. Second hooks are mounted along one side of the lower frame in spaced apart relationship for engagement with respective first hooks and holding means is provided for holding the hooks in engaged relationship.

The objects and advantages of the present invention will become apparent from a consideration of the following detailed description when taken in conjunction with the accompanying drawings.

DESCRIPTION OF THE DRAWINGS

FIG. 4 is a perspective view similar to FIG. 1 but partially exploded and depicting the top and bottom frames coupled together;

FIG. 5 is a perspective view similar to FIG. 4 but showing the load unitizer ready for lifting on board ship;

FIG. 6 is a partial longitudinal sectional view, in enlarged scale, taken along the line 6—6 of FIG. 5; and FIG. 7 is a detail view, in enlarged scale, showing connection of the connector arms to the upper frame.

DESCRIPTION OF THE PREFERRED EMBODIMENT

Figure 1:
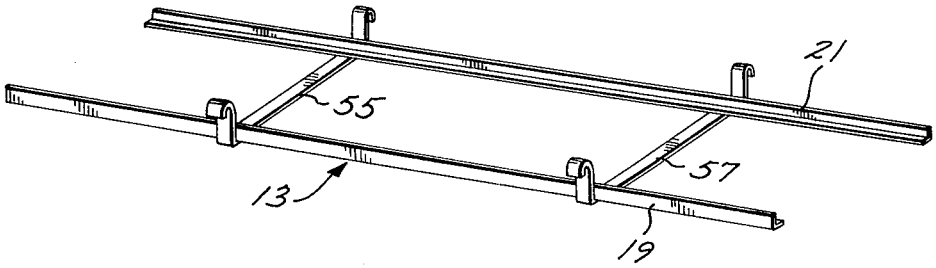
FIG. 1 is a perspective view of a bottom frame incorporated in a load unitizer embodying the present invention.

Referring to FIG. 4, the load unitizer of the present invention includes, generally, upper and lower frames 11 and 13 formed by parallel spaced apart angle irons defining corner retainers 15, 17, 19 and 21. The upper and lower frames 11 and 13 have their opposite sides connected together by means of a pair of respective coupling arms 25 and 27 which are formed on their lower extremities with coupling hooks 29 and 31 that selectively engage with complementary hooks 33 and 35 formed on the bottom frame 13. Holder brackets 37 and 39 are slidably received on the connector arms 25 and 27 for sliding downwardly into engagement with the connected hooks 29, 33, 31 and 35 to hold such hooks connected together.

Figure 2:
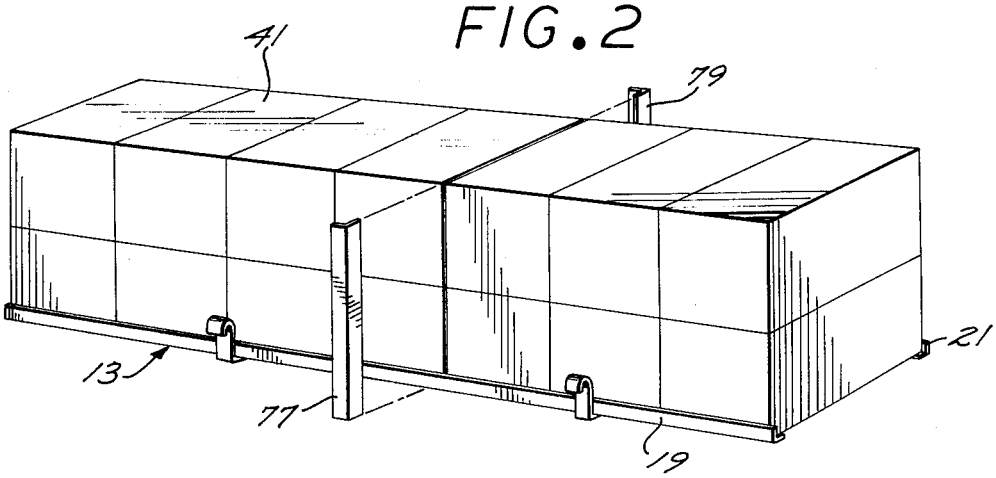
FIG. 2 is a perspective view similar to FIG. 1 but showing a plurality of cargo articles positioned on the bottom frame.
Figure 3:
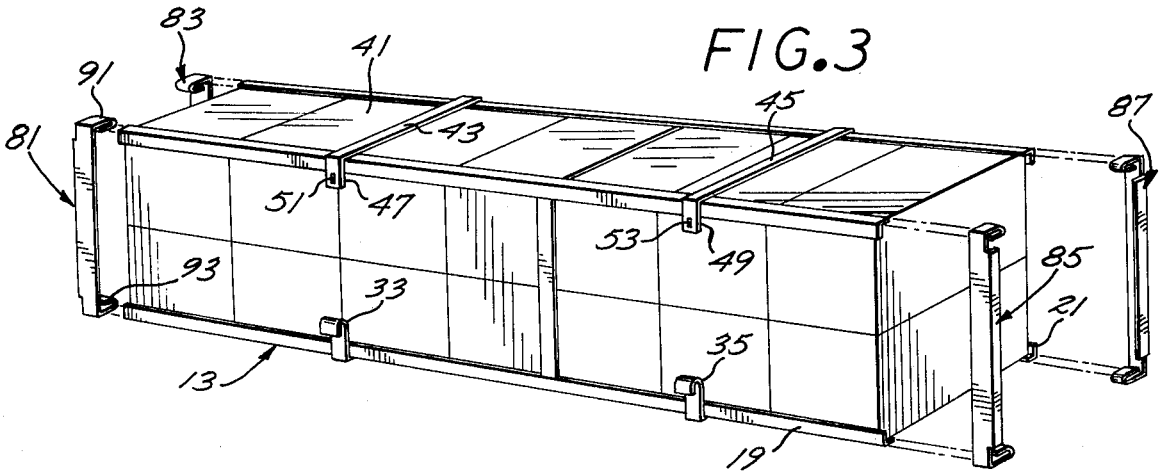
FIG. 3 is a perspective view similar to FIG. 2 but showing the top frame positioned over the cargo articles.

Thus, generally rectangularly-shaped cargo articles 41 may be stacked in a row as shown in FIGS. 2 and 3 and the frames 11 and 13 assembled about the top and bottom sides thereof to engage the respective corner retainers 15, 17, 19 and 21 with the diagonally opposed corners of such articles and the hooks 29, 33, 31 and 35 connected together to retain such articles 41 as a unit to be lifted on board a ship or the like.

The upper frame 11 is preferably formed by angle irons defining the corner retainers 15 and 17 and such retainers are connected together by transverse straps 43 and 45 which are bent downwardly at their opposite extremities to form vertically downwardly projecting connector tabs 47 and 49. Formed in the connector tabs 47 and 49 are respective rectangularly-shaped, vertically extending slots 51 and 53. The corner retainers 19 and 21 of the lower frame 13 are likewise connected together by transverse straps 55 and 57 and the opposite extremities of such straps are bent upwardly and then turned back on themselves to form the respective coupling hooks 33 and 35.

Referring to FIG. 7, the coupling arms 25 and 27 are formed by vertically extending straps turned back at their lower extremities to form the coupling hooks 29 and 31 and the upper extremities of such arms are formed with vertically extending rectangular slots 61 and 63 for alignment with the slots 51 and 53. Still referring to FIG. 7, the coupling arms 25 and 27 are connected to the coupling tabs 47 and 49 by means of pivot locks 65. The pivot locks 65 include short shafts 67 which are formed on one end with circular heads 69 and on their opposite ends with transversely extending rectangularly-shaped keys 71 which may be received through the respective aligned slots 51, 61 and 53, 63 and then rotated 90° to lock into position.

The retaining brackets 37 and 39 are in the form of generally downwardly opening U-shaped brackets with the base of the U being formed with respective rectangular slots 71 and 73 through which the respective arms 25 and 27 are slidably received.

Referring to FIGS. 2 and 4, angle-shaped side bars 77 and 79 are provided for having one leg thereof received in the vertical slot formed between adjacent cargo articles 41 with the top and bottom marginal edges of such angle irons being received behind the vertical legs of the respective corner retainers 15, 17, 19 and 21, as shown in FIG. 4.

Further, corner straps, generally designated 81, 83, 85 and 87 are provided for retaining the respective four corners of the unitized load and are also in the form of vertically extending angle irons with one leg of the top and bottom extremities of such straps being cut away and the remaining legs being bent inwardly at 90° and then back on themselves to form respective upper and lower hooks 91 and 93. Thus, the corner straps 81, 83, 85 and 87 may be slid onto the opposite ends of the respective corner retainers 15, 17, 19 and 21 with the respective hooks 91 and 93 hooked over the horizontal legs of such retainers to be held in place.

In operation, it will be appreciated that the upper and lower frames 11 and 13 may be formed by welding the cross straps 43, 45, 55 and 57 to the respective corner retainers 15, 17, 19 and 21. The coupling arms 25 and 27 may then be formed and quickly assembled to the top frame by the lock pins 65 for pivotal movement of such arms.

When the load unitizer is to be utilized in unitizing a load, the bottom frame 13 may be positioned on the deck as shown in FIG. 1 and seven rows of cargo articles 41, two columns high, such as cartons for motorcycles, assembled thereon and the side bars 77 and 79 brought into position with the transverse legs thereof being received within the slot formed between adjacent articles 41 and the bottom marginal edge thereof being received behind the vertical leg of the bottom corner retainers 19 and 21. The top frame 11 may then be brought into position on the top of the row of articles 41 and the corner straps 81, 83, 85 and 87 quickly brought into position with the hooks 91 and 93 received over the horizontal legs of the respective corner retainers 15, 17, 19 and 21. The coupling arms 25 and 27 may then be quickly coupled to the top frame 11 by means of the lock pins 65 and the arms 25 and 27 rotated downwardly to engage the hooks 29 and 31 with the respective complementary hooks 33 and 35 and the holding brackets 37 and 39 then slid downwardly over the engaged respective hooks 29, 33, 31 and 35 to hold such hooks in position.

A lifting frame, generally designated 97, may then be suspended from a loading boom with respective hooks 99 engaged beneath the vertical legs of the top corner retainers 15 and 17 to lift the unitized load on board ship for storage in the hold thereof. After the ship has been entirely loaded, it may then leave port for its destination and, upon discharge of the cargo at that destination, the unitized load may be unloaded by a boom in a manner similar to loading thereof.

The unitized load may be disassembled at that point or at its final destination by merely lifting upwardly on the holding brackets 37 and 39 and pivoting the coupling arms 25 and 27 about their lock pins 65 to disengage the coupling hooks 29, 33 and 31, 35 to free the top frame 11 for removal from the cargo articles 41. The corner straps 81, 83, 85 and 87 may be withdrawn from the ends of the corner retainers 15, 17 and 19 and the side bars 77 and 79 removed. The cargo articles 41 and then free for separation and transportation to their respective storage areas to thus free the bottom frame 13. The entire unitizer may then be melted down as scrap iron or a number thereof may be collected together in a small package for return to their original source for subsequent use in transporting more articles 41. Further, it will be clear that such unitizer may be utilized to transport additional cargo back to the source of such unitizer.

From the foregoing it will be apparent that the load unitizer of the present invention provides an economical and effective means for unitizing cargo articles for shipment thereof and that upon discharge of the cargo articles, the unitizer may be quickly and easily disassembled and, if desired, shipped back to the source in a relatively small package, thus conserving shipping space. Further, due to the relatively inexpensive nature of such load unitizer, the unitizer itself may be scrapped, thus rendering it a one-way container. It will be appreciated that considerable time will be saved over the individual handling of numerous different articles and that unitization actually conserves storage space in the ship hold and serves to protect the articles themselves.

Various modifications and changes may be made with regard to the foregoing detailed description without departing from the spirit of the invention.

I claim:

1. A load unitizer for holding as a unit a plurality of cargo articles formed with opposed upper and lower corners and of uniform size to be collected together in a row to dispose the respective common corners of said articles in respective straight lines, said unitizer comprising:

upper and lower frames including respective pairs of spaced apart upper and lower corner retainers for projecting longitudinally of said row of articles, said upper corner retainers being shaped in cross section to nest over said opposite corners of said articles and said lower corner retainers being shaped in cross section to nest over said bottom corners of said articles;

coupling means including connecting arms pivotally connected on their upper extremities in spaced apart relationship to one side of said upper frame and formed on their lower extremities with respective turned-back portions defining first hooks;

second hooks mounted from said one side of said lower frame in spaced apart relationship for connecting with said respective first hooks; and holding means for holding said first and second pairs of hooks connected to one another whereby said cargo articles may be assembled in a row on said lower frame with the respective corners thereof aligned with said upper frame positioned over said articles and said first and second hooks engaged together to hold said frames together and retain said articles on a unit for transfer thereof.

2. A load unitizer as set forth in claim 1 wherein:

said holding means includes U-shaped brackets formed at their bases with slots for passage of said arms, said brackets being slidable downwardly on said arms to engage the opposite legs thereof over the opposite sides of the engaged hooks.

3. A load unitizer as set forth in claim 1 that includes:

side bars disposed on opposite sides of said frames and having their upper and lower marginal ends received between said corner retainers and said articles.

4. A load unitizer as set forth in claim 1 wherein:

said upper frame is formed on its opposite sides with downwardly projecting longitudinally spaced apart mounting tabs formed with rectangular slots;

said connecting arms are formed at their upper extremities with rectangular slots overlying said respective first-mentioned slots; and said unitizer includes lock pins including respective shafts receivable through said respective slots and formed on their one extremities with integral enlarged-in-cross section heads and on their opposite extremities with enlarged-in-cross section rectangular keys receivable in their longitudinal direction through said slots but having their long dimension longer than the width of said slots so turning thereof 90° locks said pins in place in said respective slots.

5. A load unitizer as set forth in claim 1 that includes:

vertically extending corner straps formed on their upper and lower extremities with hooks slidably received over the ends of said corner retainer.

6. A load unitizer as set forth in claim 1 for unitizing cargo articles having right angle corners and wherein:

said corner retainers are in the form of right angle members for nesting therein of right angle corners and said frames include rigid cross members connecting the retainers of the upper frame together and the retainers of the lower frame together.

7. A load unitizer as set forth in claim 1 wherein:

said coupling means includes a second pair of connecting arms pivotally connected on their upper extremities in spaced apart relationship to the side of said upper frame opposite said one side and formed on their lower extremities with respective third hooks;

fourth hooks mounted from said one side of said lower frame in spaced apart relationship for connecting with said respective third hooks; and holding means for holding said third and fourth pairs of hooks connected with one another.

8. A load unitizer as set forth in claim 6 wherein:

said coupling arms include straps pivotally connected on their upper extremities to said upper frame and formed on their lower portions with extremities turned back on themselves to form said respective first hooks.

9. A load unitizer as set forth in claim 6 wherein:

said holding means includes U-shaped brackets formed at their bases with slots for passage of said arms, said brackets being slidable downwardly on said arms to engage the opposite legs thereof over the opposite sides of the engaged hooks.

* * * * *